US005395225A

United States Patent [19]

Johansson

[11] Patent Number: 5,395,225

[45] Date of Patent: Mar. 7, 1995

[54] SCREW PUMP HAVING ECCENTRIC CIRCULAR SEALING DISCS

[76] Inventor: Anders Johansson, Hasselgatan 10, S-42177 V.Frölunda, Sweden

[21] Appl. No.: 949,530

[22] PCT Filed: Mar. 21, 1991

[86] PCT No.: PCT/SE91/00219

§ 371 Date: Nov. 25, 1992

§ 102(e) Date: Nov. 25, 1992

[87] PCT Pub. No.: WO91/14869

PCT Pub. Date: Oct. 3, 1991

[30] Foreign Application Priority Data

Mar. 29, 1990 [SE] Sweden ..... 9001145

[51] Int. Cl.[6] ..... F04C 3/04

[52] U.S. Cl. ..... 418/195; 418/196

[58] Field of Search ..... 418/195, 196, 226, 204

[56] References Cited

U.S. PATENT DOCUMENTS 2,413,209 12/1946 Bejeuhr ..... 418/195

3,726,616 4/1973 Powers ..... 418/196

FOREIGN PATENT DOCUMENTS 218304 1/1968 Sweden .

WO82/03428 10/1982 WIPO .

*Primary Examiner*—John J. Vrablik

*Attorney, Agent, or Firm*—Klarquuist Sparkman Campbell Leigh & Whinston

[57] ABSTRACT

Screw pump of the type which comprises a rotatable screw (16) in a housing (11), the threads (20, 21) of which are partially in engagement with a rotatable sealing device (19). The screw area of the screw (16), that is, the thread groove (20) and thread root (21) of which are generated by a generatrix (22), which is a part of a circle arc, the circle of which is rotatable about an eccentric rotation axis (23), when the generatrix rotates about the shaft of the screw (24) and displaced along this with a velocity which is proportional to the rotational velocity of the screw. The sealing device (19) comprises at least one circular disc (25), the eccentric rotation axis (26) of which, being arranged transverse to the axis (24) of the screw, coincides with the rotation axis of the generatrix.

3 Claims, 8 Drawing Sheets

SCREW PUMP HAVING ECCENTRIC CIRCULAR SEALING DISCS

The present invention refers to a screw pump of the type which comprises a rotatable screw in a house, the threads of which are in engagement with a rotatable sealing device.

BACKGROUND OF THE INVENTION

Industrial waste products, such as waste chemicals, waste oil and so on are often of very high viscosity and heavily contaminated with wearing particles in varying size. When pumping these media it is important to use a low speed pump as possible, which can swallow large particles and to give the high viscous medium good time to flow up.

Today among others so called modified archimedes screw pumps are used, with a multiple toothed radially positioned sealing and pressure build-up disc, which is in engagement with the screw. An example on such screw pump is described in SE-B-8101863. Because of the geometry of the sealing disc the meshing part of the screw can not simply be machined, which implies bad sealing and high wear on included parts. The displacement is limited by screw flanks during one screw turn and the cylinder wall and two successive teeth on the sealing disc. In practice the whole screw diameter cannot be used, since the screw must have a supporting center shaft, which steals a part of the displacement of the pump. Moreover the relatively large sealing disc demands large space, which results in the pump being bulky.

OBJECT OF THE INVENTION AND MOST ESSENTIAL FEATURES

The object of the invention is to provide a screw pump of the type stated by way of introduction, the pump screw of which can be machined, which has a very large displacement, which can swallow large particles in respect to its diameter, which has small build in dimensions and which is characterized in low wear between the pump screw and the sealing discs, which results in long life and long periods between the services. Moreover a change of the wearing parts such as the gaskets of the sealing discs should be possible to be carried out rapidly and in some simple operations. These tasks have been solved by the screw area of the screw, that is the thread groove and the thread root is generated by a generatrix, which is a part of a circular arc, the circle of which can rotate around an eccentric rotation axis, when the generatrix rotates around the axis of the screw and is moved along this with a velocity which is proportional to the rotation velocity of the screw, and that the sealing device comprises at least one circular disc, the eccentric rotation axis of which, is arranged crosswise towards the axis of the screw, coincides with the rotation axis of the generatrix.

DESCRIPTION OF THE DRAWINGS

The invention will be described in closer detail with reference to the drawings, which describe an embodiment.

DESCRIPTION OF EMBODIMENTS

Figure 1:
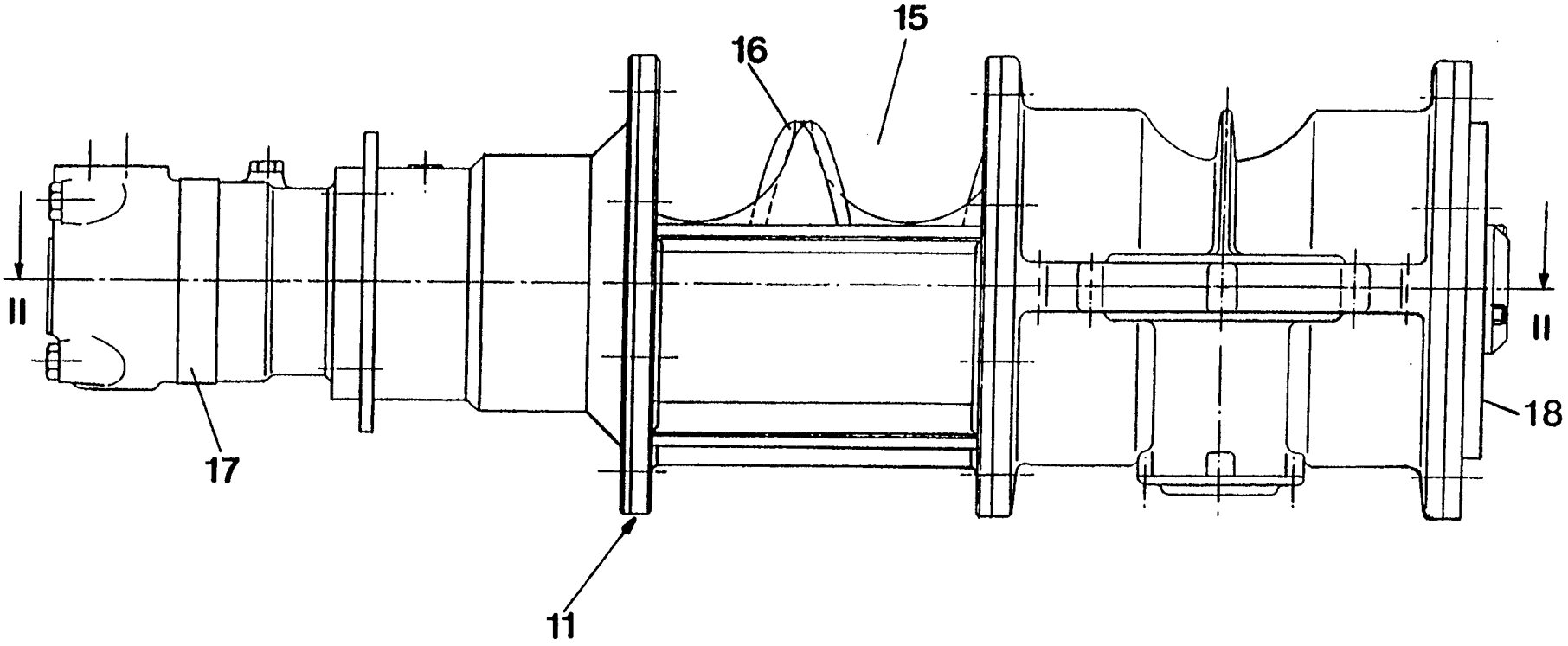
FIG. 1 shows the screw pump according to the invention in a lateral view.
Figure 2:
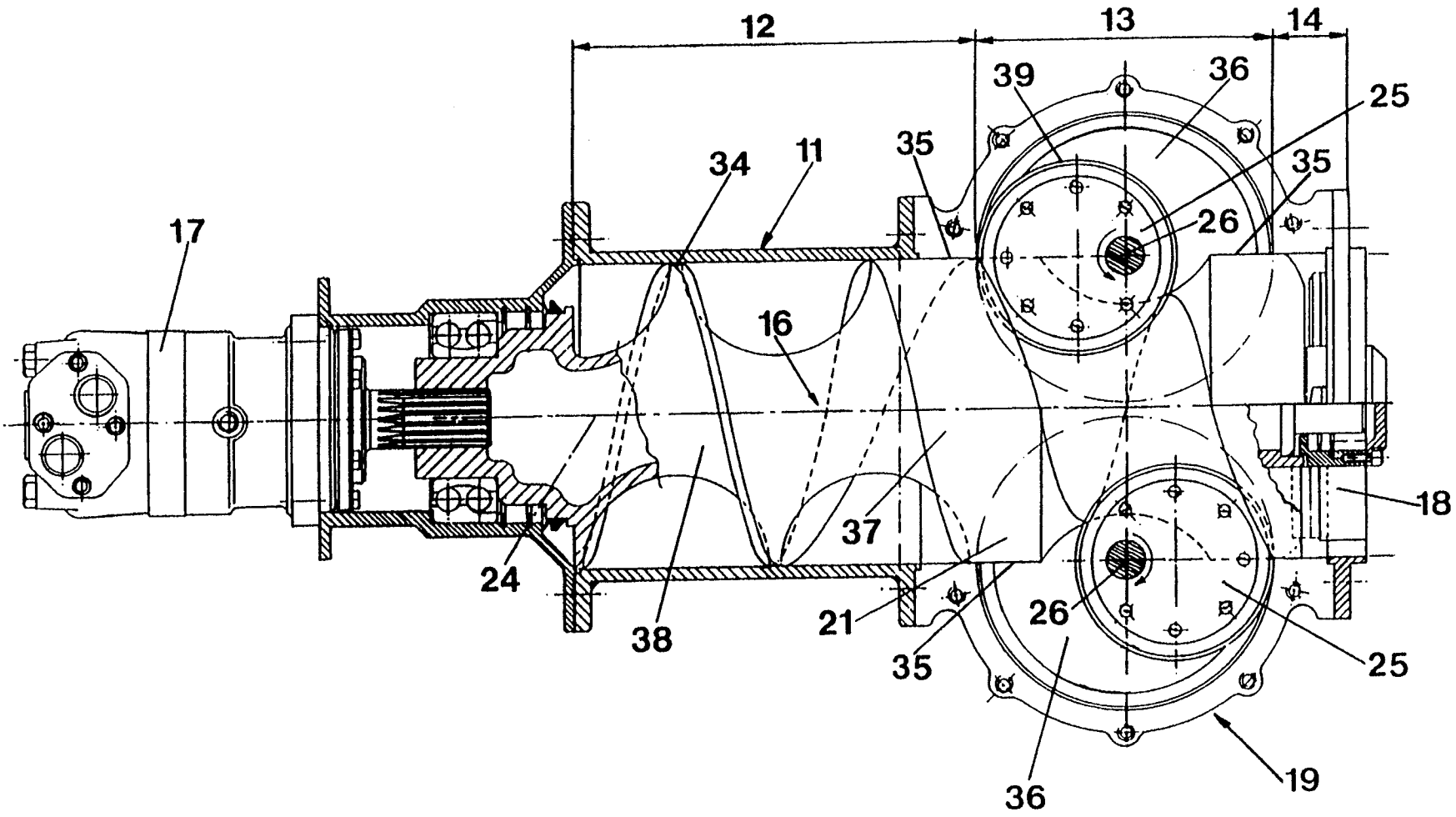
FIG. 2 shows a section along the line II—II in FIG. 1 and with the sealing discs shown in an initial position.
Figure 3:
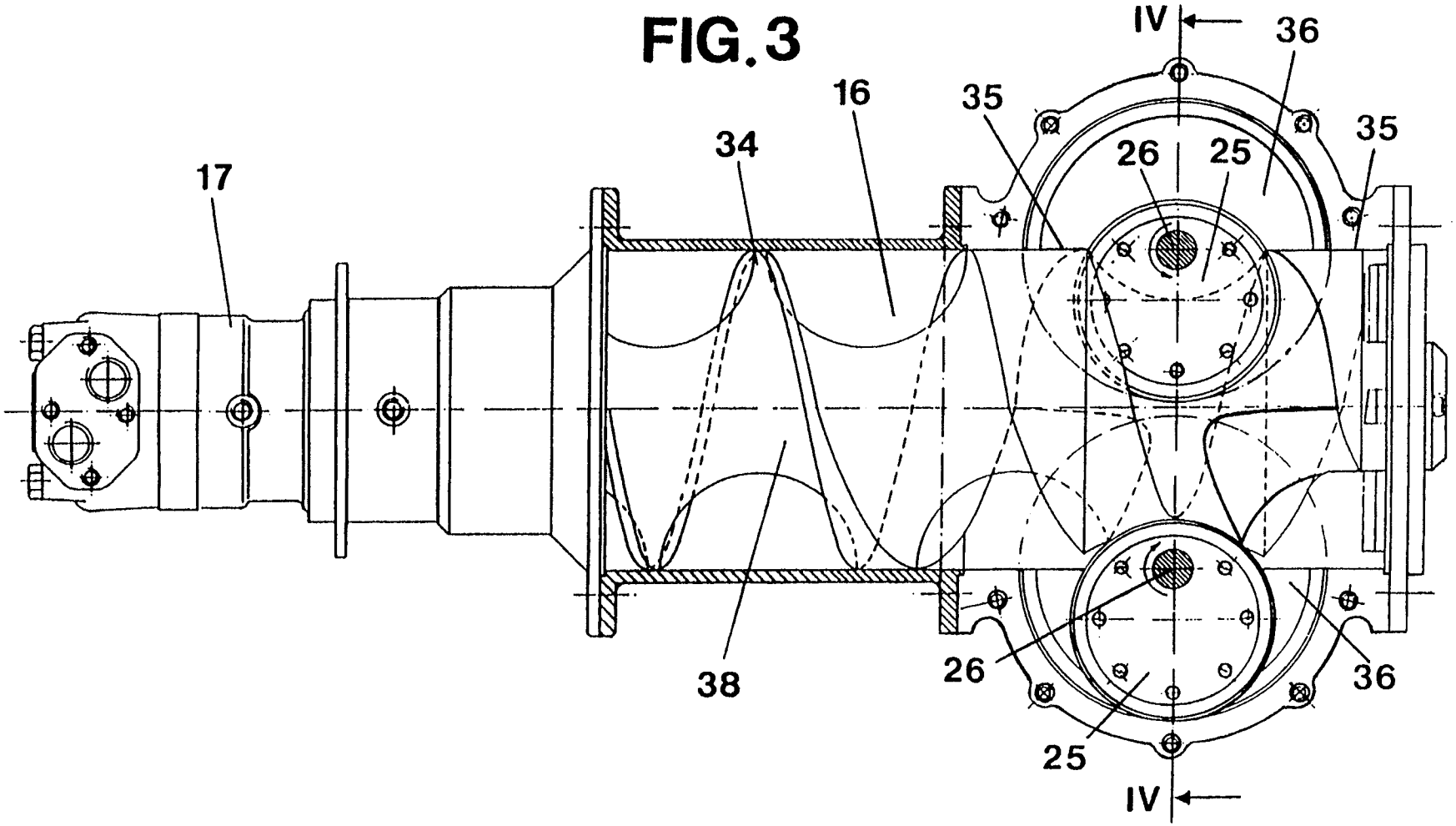
FIG. 3 shows a view analogous with FIG. 2 of the screw pump with the sealing discs rotated 90° relatively the sealing discs in FIG. 2.
Figure 5:
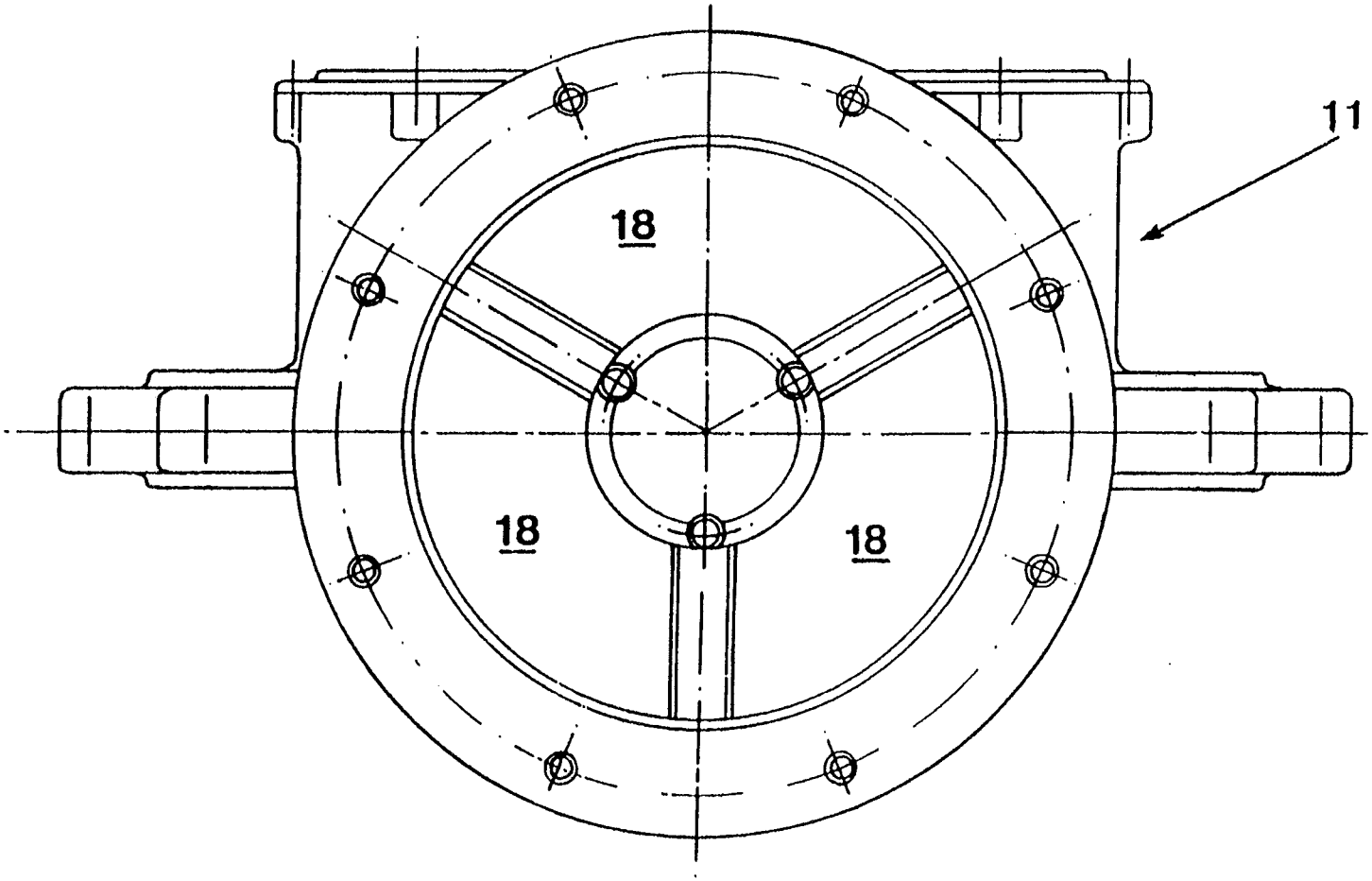
FIG. 5 shows an end view of the screw pump according to the invention with the output opening.
Figures 6, 7:
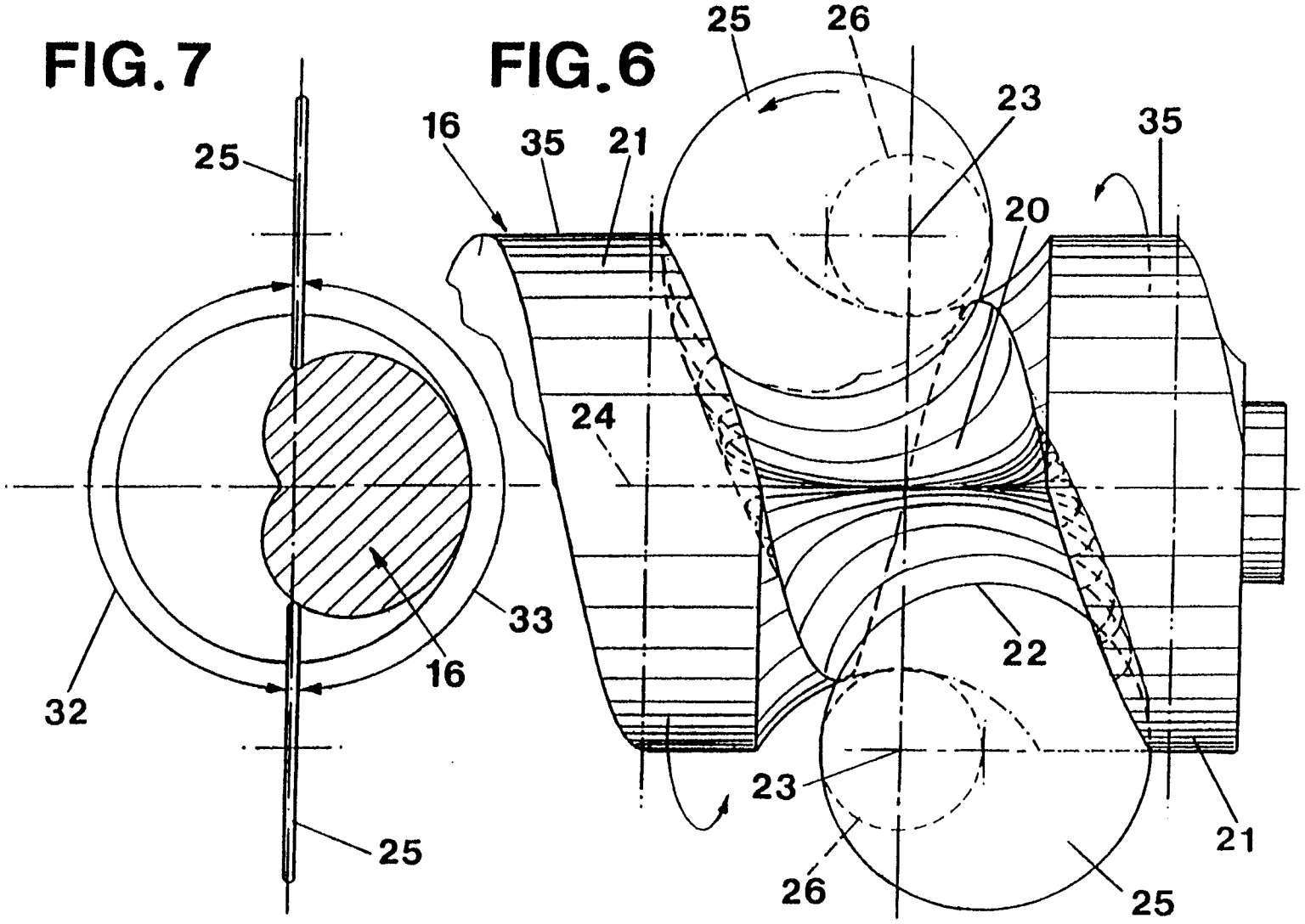
FIG. 6 is a fragmentary side elevation view of a rotatable screw and sealing device of the present invention illustrating the attitude of parts thereof during the operation thereof.
FIG. 7 is a cross-sectional view of the rotatable screw and sealing device as shown in FIG. 6 taken along the section line in FIG. 6.
Figure 8:
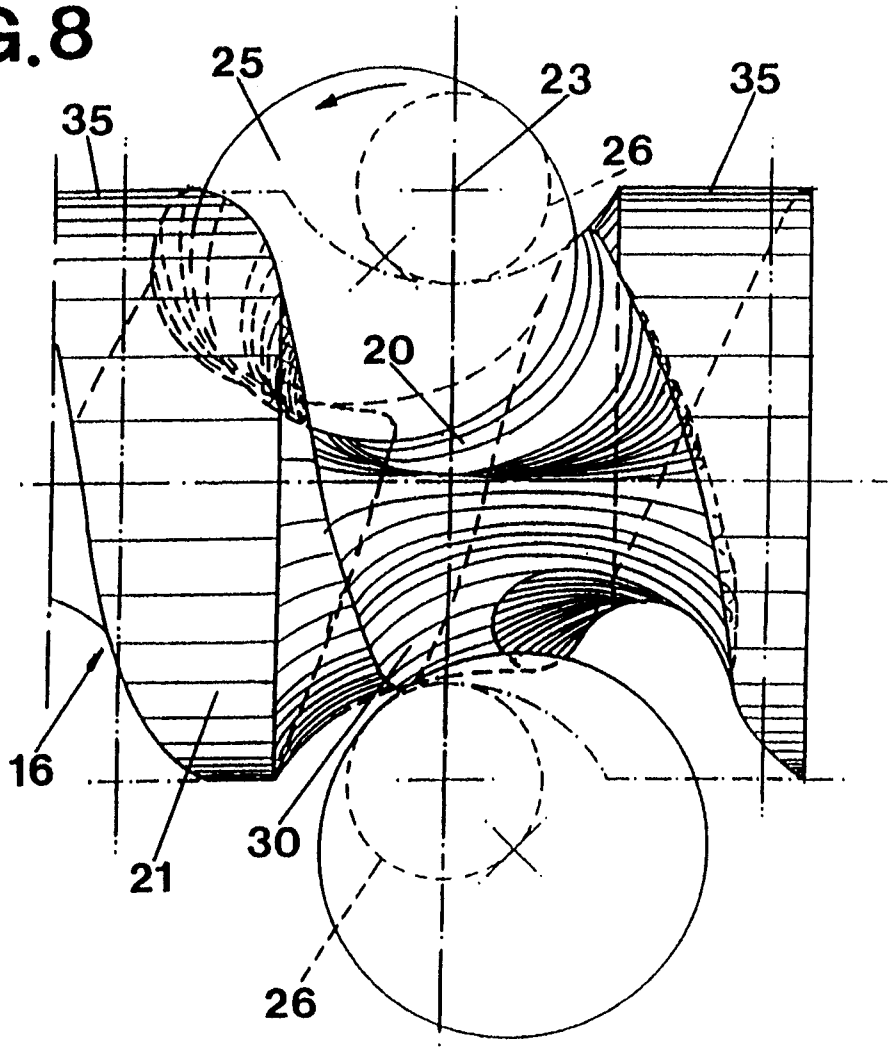
FIG. 8 is a fragmentary side elevation view of the rotatable screw and sealing device of the present invention showing attitude of parts thereof at a different time.
Figure 9:
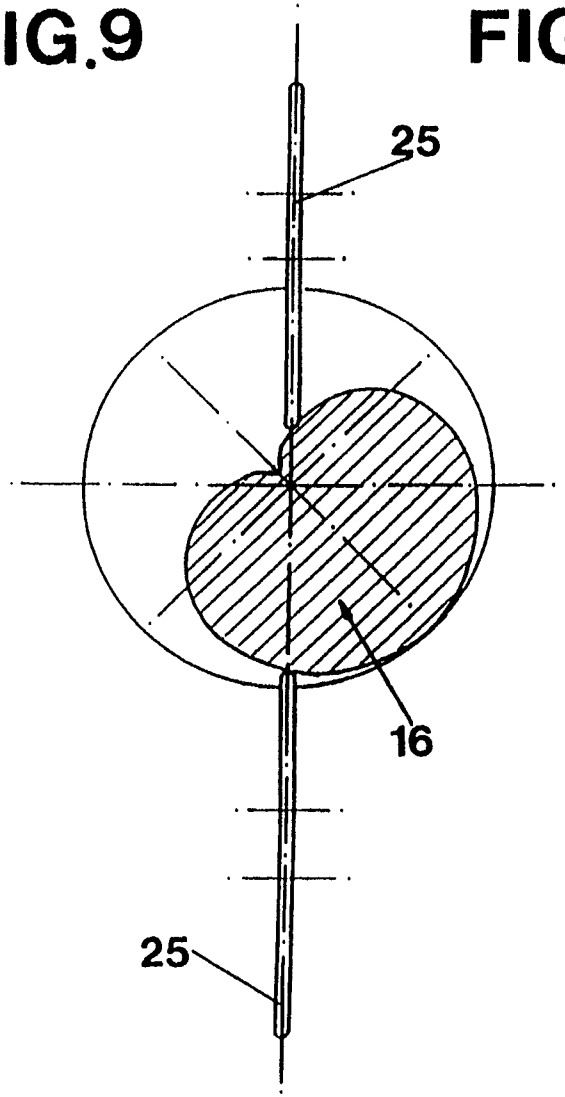
FIG. 9 is a cross-sectional view of the rotatable screw and sealing device as shown in FIG. 8 taken along the section line in FIG. 8.
Figure 10:
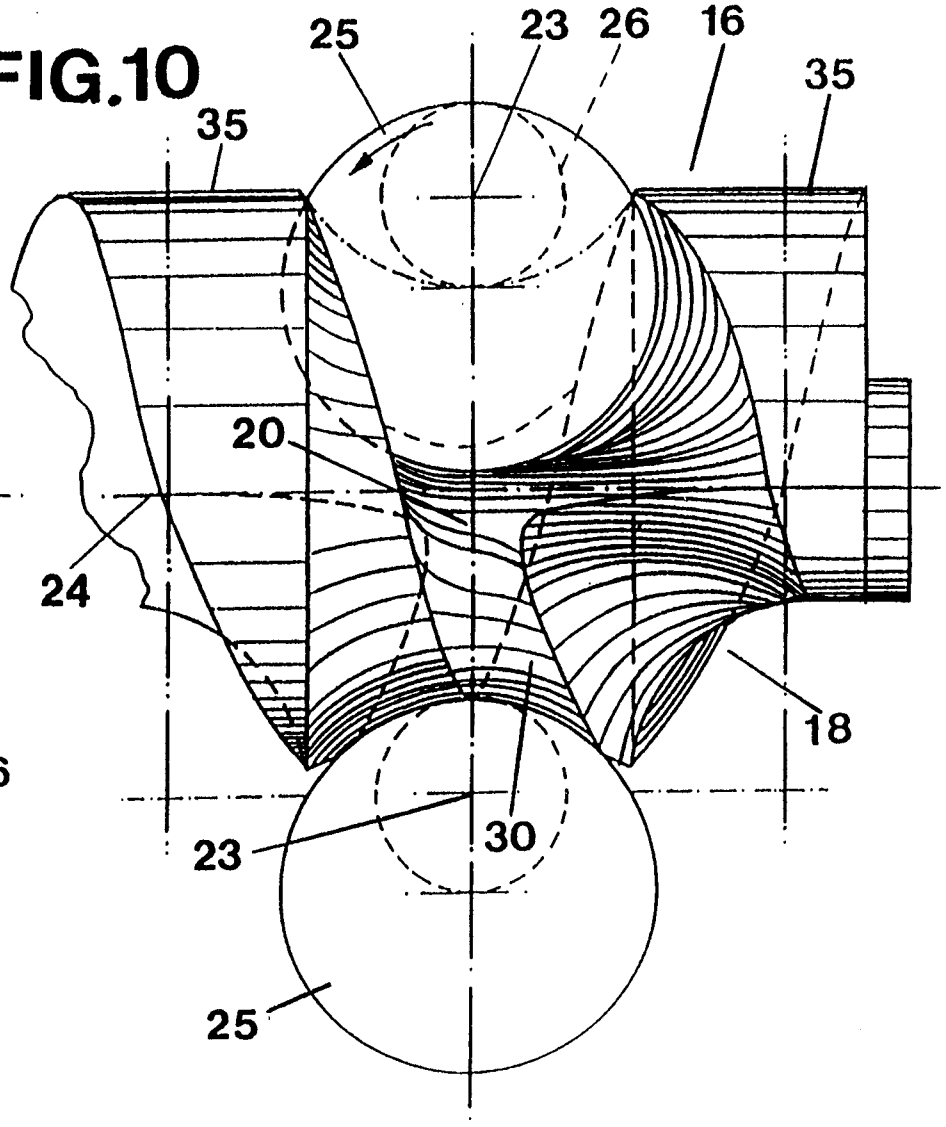
FIG. 10 is a fragmentary side elevation view of the rotatable screw and sealing device showing the attitude of parts thereof at still another time in the operation of the device.
Figure 11:
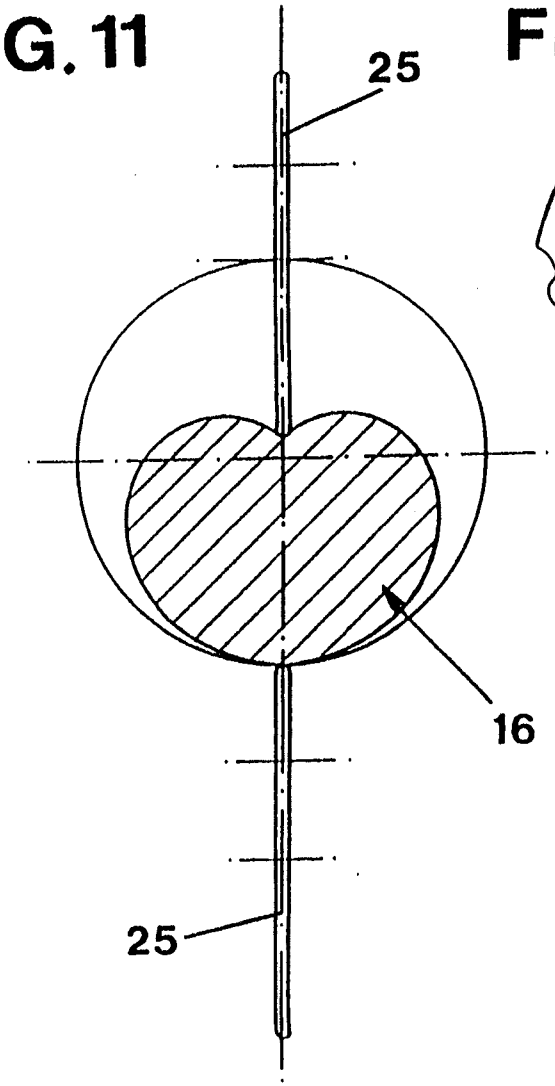
FIG. 11 is a cross-sectional view of the rotatable screw and sealing device as shown in FIG. 10 taken along the section line in FIG. 10.

The screw pump according to the invention consists of a pump housing 11, which comprises an input section 12, a compression section 13 and an output section 14. The input section 12 is provided with an input opening 15 at one end of a screw 16, which extends throughout the whole pump housing 11 and the periphery of which is cylindric in the same way as the inside of the pump housing. At one side of pump housing a motor 17 is fixed by screws, which preferably can be a hydraulic motor, the drive shaft of which is nonrotateably connected to the screw 16. At the opposite end of the screw pump in the output section an output opening 18, such as shown in FIGS. 2 and 5.

The compressing section 13 of the screw pump comprises partly a specially designed portion of the screw and partly with this cooperating sealing device 19, which cooperates with the screw 16.

The compressing section of the screw 16 is formed as a screw surface, that is a thread groove 20 and a thread root 21, which is generated by a generatrix, which is a part of a circular arc 22, the circle of which is rotateable about an eccentric rotation axis 23, when the generatrix rotates about the shaft 24 of the screw 16 and simultaneously is moved along this with a velocity which is proportional to the rotation velocity of the screw. The thread groove 20 and the thread root 21 within the compressing section 13 has obtained the form shown in the FIGS. 6 to 11, that is, the screw 16 has a deep recessed portion within the part where the operation phase is positioned, while the part of the screw which is comprised by its return phase to a great extent is absorbed by the supporting cross section of the screw.

Figure 4:
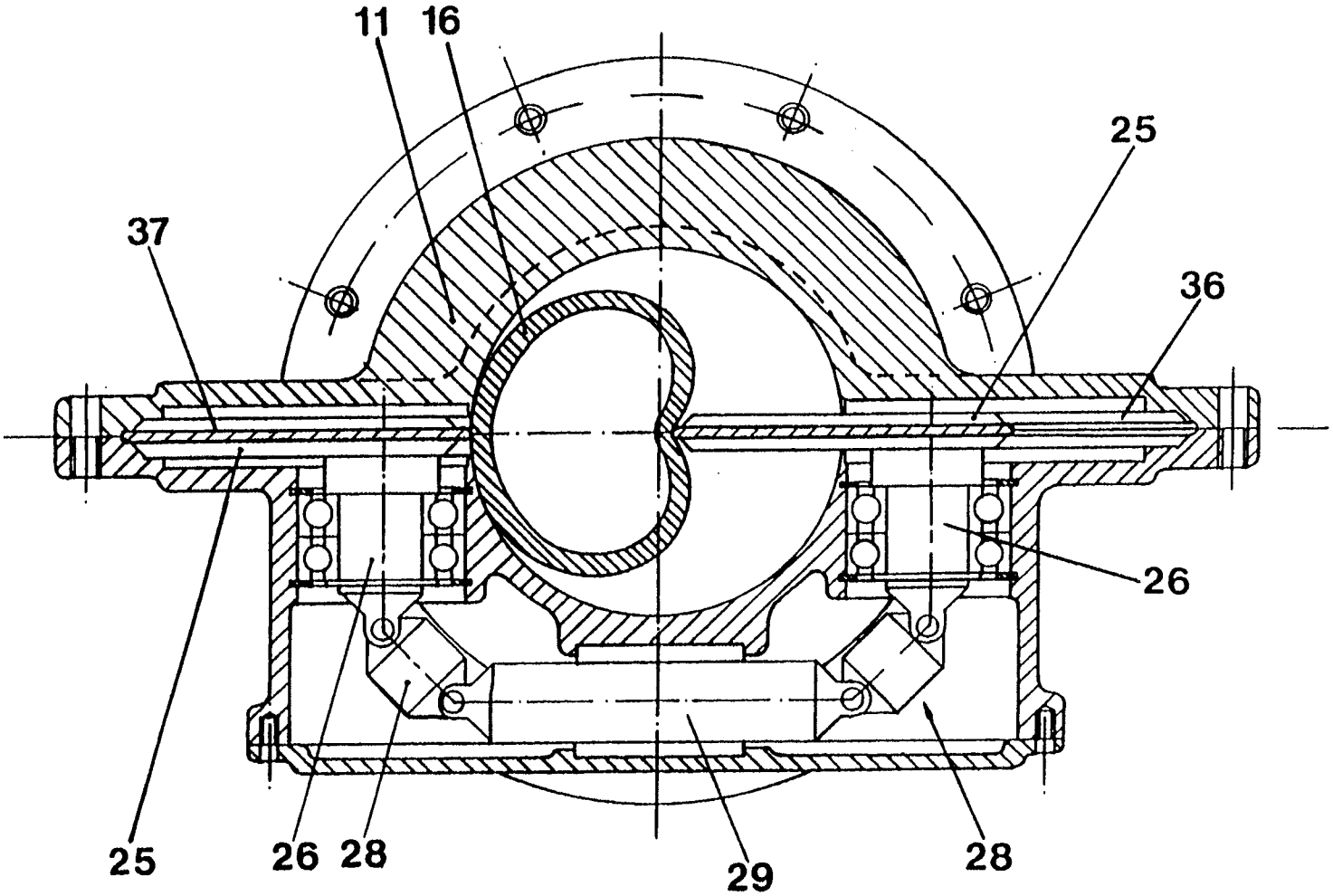
FIG. 4 is a section along the line IV—IV in FIG. 3.

The sealing device situated within the compressing section 13 in the embodiment shown is constituted by two sealing discs 25, which are rotateable about an eccentrically arranged shaft 26, which coincides with the geometric axis 23. Each sealing disc 25 is provided with a peripheral sealing means 39. The sealing discs 25 are arranged radially relatively the screw 16 and are situated just opposite each other whereby the size of the sealing discs and the position of the eccentric shaft 26 has been chosen such, that the sealing disc 25 which is active for the present, in one of its end positions extends almost up to the center axis 24 of the screw. The two shafts 25 and 26 of the sealing discs are connected by means of a transmission 27, which in the embodiment shown in FIG. 4 is constituted by double cardan joints 28 connected to each other by means of a shaft 29. The sealing discs 25 obtain their rotating driving power from the screw 16.

The sealing discs 25 are 180° displaced in phase, which means that it is only one sealing disc at at time, that lies in working position during respectively the half operation revolution of the screw. The sealing disc 25 which is not operative, that is, which has only sealing function, is returned to the initial position by it being connected by the cardan joints 28 with the other, for the present active sealing disc, until it comes to the position where the operation cycle starts. This means that only 180° of the pump screw operates actively. It is then possible to use the non active half to physically support the screw and let the operating disc run all way down to the center of the screw and there by obtain maximum displacement. The working phase 32 is thus used two times per revolution. In order to obtain a soft transition from the working phase 32 along the whole return phase 33, the thread groove 20 passes over into a partly circular return path 30, which returns respective sealing disc 25 to the active part of the thread groove 20.

In order to prevent internal leakage between the screw 16 and the sealing disc 25 on the side, where it is positioned in the operation phase, the cylindrical thread crests 34 of the screw have been designed with an axial extension 35, which is so large, that it during the whole operation phase seals the recess 36, in which the sealing disc 25 is movable. The screw 16 can be divided into a compression screw 37 situated within the compression sector 13 and a feeding screw 38 provided within the input section 12. The axial extension 35 of the compression screw 37 at the thread roots is successively narrowing in the feeder screw 38.

To sum up the following advantages may be quoted:

1. Sealing disc which extends all way down to the center of the screw implies maximum displacement in reference to the diameter of the screw and that large particles can be pumped.

2. 180° operating phase which can be used 2 times per revolution.

3. Supporting screw shaft which lies in the return phase and does not contribute to dead volume.

4. The screw pump can also be made with 4 discs and 90° operation phase which then will be completely self sealing.

5. Wide thread crest which gives a self sealing screw against the return path of the disc.

6. Circular sealing discs (wear detail) which will be inexpensive to manufacture.

7. Rounded outer diameter on the sealing disc which "rolls" over screw shaft for exact sealing.

8. Circular sealing discs make the screw machineable and thereby tighter and less wear.

9. The sealing discs are linked together with 180° phase displacement by means of double cardan joints so that the operating disc returns the resting one.

10. Alternating wear and seal surface on the sealing discs which gives lower wear.

I claim:

1. A screw pump comprising:

a housing;

a rotatable screw disposed in the housing, the rotatable screw having a thread groove and a thread root forming a generatrix when the screw is rotated about its longitudinal axis;

a rotatable sealing device including first and second circular sealing discs disposed in the housing and having the rotatable screw disposed between the sealing discs, each sealing disc having a circular outer surface being at least in partial engagement with the thread groove of the rotatable screw;

a first eccentrical shaft being mounted eccentrically to the first sealing disc;

a second eccentrical shaft being mounted eccentrically to the second sealing disc;

each eccentrical shaft having a longitudinal axis that is perpendicular to the longitudinal axis of the rotatable screw whereby when the rotatable screw is rotated about its longitudinal axis, the discs are eccentrically rotated about the shafts by the rotatable screw; and means for nonrotateably connecting the first sealing disc to the second sealing disc so that there is about a 180° degree phase difference therebetween.

2. A screw pump according to claim 1 wherein each sealing disc comprises a peripheral sealing means for providing a seal between the sealing discs and the rotatable screw.

3. A screw pump comprising:

a housing;

a rotatable screw disposed in the housing, the rotatable screw having a thread groove and a thread root forming a generatrix when the screw is rotated about its longitudinal axis, the thread root having a cylindrical thread crest surface;

a rotatable sealing device including at least first and second circular sealing discs, the first sealing disc being disposed within a first recesses formed inside the housing, the second sealing disc being disposed within a second recess formed inside the housing, the discs having the rotatable screw disposed therebetween;

each sealing disc having a circular outer surface being at least in partial engagement with the thread groove of the rotatable screw;

a first eccentrical shaft being mounted eccentrically to the first sealing disc;

a second eccentrical shaft being mounted eccentrically to the second sealing disc;

each eccentrical shaft having a longitudinal axis that is perpendicular to the longitudinal axis of the rotatable screw whereby when the rotatable screw is rotated about its longitudinal axis, the discs are eccentrically rotated about the shafts by the rotatable screw; and the first sealing disc being rotatable into an operation phase by rotating the first sealing disc to project inwardly towards the thread groove of the rotatable screw; and the thread crest surface having a successively narrowing width as the rotatable screw extends away from the sealing discs, the width being sufficiently wide so that the crest surface and the first sealing disc together cover the first recess when the first sealing disc is in the operation phase.

* * * * *